US007014011B1

(12) United States Patent
Alexander

(10) Patent No.: US 7,014,011 B1
(45) Date of Patent: Mar. 21, 2006

(54) SCAFFOLDING LIFT SYSTEM

(76) Inventor: Honore Ivory Alexander, 1011 Scales St., Salisbury, NC (US) 28144

( * ) Notice: Subject to any disclaimer, the term of this patent is extended or adjusted under 35 U.S.C. 154(b) by 171 days.

(21) Appl. No.: 10/767,099

(22) Filed: Jan. 30, 2004

(51) Int. Cl.
*E04G 1/00* (2006.01)
*E04G 1/18* (2006.01)
*E04H 12/00* (2006.01)

(52) U.S. Cl. ..... 182/179.1; 182/145; 52/651.1

(58) Field of Classification Search ..... 182/179.1, 182/178.1, 145, 141, 142, 129; 52/637, 638, 52/651.1; 187/401–406, 239–244, 900
See application file for complete search history.

(56) References Cited

U.S. PATENT DOCUMENTS 2,066,221 A * 12/1936 Payne ..... 182/143
2,364,547 A 12/1944 Olsen
2,420,903 A * 5/1947 Noble ..... 182/144
2,423,167 A * 7/1947 Aune ..... 182/145
2,493,695 A * 1/1950 Payne ..... 187/243
2,531,346 A 11/1950 Schuchert
2,725,125 A * 11/1955 Morgen ..... 182/145
2,762,659 A * 9/1956 Campbell et al. ..... 182/141
2,798,574 A * 7/1957 Wardell ..... 182/145
2,890,082 A * 6/1959 McDaniel et al. ..... 182/144
2,904,126 A * 9/1959 Meng et al. ..... 182/148
2,989,320 A * 6/1961 Pennington ..... 182/69.6
3,236,331 A * 2/1966 Green ..... 182/144
3,318,414 A * 5/1967 Meek ..... 182/146
3,638,757 A * 2/1972 Sampson ..... 182/145
3,785,454 A * 1/1974 Behunin et al. ..... 182/145
3,951,236 A 4/1976 Schreiber et al.
4,262,773 A * 4/1981 Basham ..... 182/145
4,452,337 A * 6/1984 Atzinger ..... 182/178.5
4,633,975 A * 1/1987 Connor et al. ..... 182/143
5,058,708 A 10/1991 Herman
5,152,369 A 10/1992 Nakaoka
6,253,875 B1 7/2001 Trindade et al.
6,321,872 B1 * 11/2001 Parker ..... 182/142
6,401,863 B1 * 6/2002 Kirkland ..... 182/142
6,405,831 B1 * 6/2002 Daniel, III ..... 182/141
6,776,259 B1 * 8/2004 Murten ..... 182/129
6,863,159 B1 * 3/2005 Rauch ..... 187/206

FOREIGN PATENT DOCUMENTS

DE 4105779 A1 * 8/1992

* cited by examiner

*Primary Examiner*—Hugh B. Thompson, II

(57) ABSTRACT

A scaffolding lift system includes a base member and a plurality of elongated vertical support members secured to the top surface of the base member. A power-operated motor is positioned adjacent the scaffolding and on the base member. The scaffolding further includes a plurality of elongated horizontal support members connected to select ones of the plurality of vertical support members and extend rearwardly thereof. An elongated boom is engaged with the rear portion of the scaffolding and extends forwardly therefrom. The scaffolding further includes a plurality of pulleys connected thereto and disposed adjacent to the boom at different heights respectively. A flexible elongated cable is supported by the plurality of pulleys and has a first end portion secured to the motor. The cable further has a second end portion including a hook mechanism for selectively engaging a pallet.

15 Claims, 2 Drawing Sheets

SCAFFOLDING LIFT SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a scaffolding lift system and, more particularly, to a power operated scaffolding lift system including an elongated base member for supporting a scaffolding thereabove.

2. Prior Art

In performing construction work on a building, it is often required to work at locations above the ground adjacent a building. Typically, to work in such locations, construction personnel erect building scaffolding to permit them to stand on a platform supported above the ground by the scaffolding. Such platforms are usually accessed with the use of a ladder.

If the job requires that heavy articles such as bricks or concrete block are needed on the platform, a construction worker must carry such bricks or block up the ladder or must employ a forklift truck or crane to lift the heavy articles. Carrying the articles up the ladder by hand is impractical and the use of a forklift truck or crane adds to the complexity and cost of completing the work on the building. What is needed therefore is a builder's lift device which is economical to manufacture, easy to carry over rough ground, quick to install and dismantle, eliminates the need to carry objects up the ladder, and which eliminates the use of a forklift truck and crane.

The temporary scaffolding commonly employed in construction provides elevated staging areas for materials, workers and equipment. Such scaffolding is available in generally rectangular frames, and is normally set up in pairs interconnected by diagonal bracing to form relatively rigid scaffolding frameworks. The frames are often stackable so that scaffolding systems can be assembled to various heights. Typically, planks are extended between the spaced scaffolding frames to provide staging areas for the materials, workers and equipment.

An exemplary use of such a scaffolding system is in masonry construction, which often requires the elevation of relatively large amounts of materials. As the masonry construction progresses upwardly, mortar and the masonry units (e.g. bricks, blocks, stones, etc.) are lifted to staging areas on the scaffolding system at appropriate heights. On many masonry construction jobs, the materials are elevated entirely by manual laborers.

However, manually stocking an elevated work staging area with masonry materials tends to be relatively time-consuming, expensive, and unsafe. Naturally, the time and expense of manually stocking a staging area increases with the height to which the materials must be elevated. To reach a staging area atop multiple scaffolding levels, the materials must be lifted and set down through a series of intermediate staging areas, the vertical separation of which is limited by the height that a laborer can elevate the materials in one motion.

Accordingly, a need remains for a scaffolding lift system that overcomes the above-noted shortcomings.

BRIEF SUMMARY OF THE INVENTION

In view of the foregoing background, it is therefore an object of the present invention to provide a system for elevating platforms adjacent a building scaffolding to a location above the ground. These and other objects, features, and advantages of the invention are provided by a scaffolding lift system including a base member having substantially planar bottom and top surfaces.

The system further includes a scaffolding including a plurality of elongated vertical support members having lower end portions secured to the top surface of the base member and upper end portions extending upwardly therefrom respectively. A power-operated motor is positioned adjacent the scaffolding and on the base member. The base member has a rear portion generally aligned with the rear portion of the scaffolding and further has a front portion extending beyond the power-operated motor so that the system can be supported above the base.

The scaffolding further includes a plurality of elongated horizontal support members connected to select ones of the plurality of vertical support members and extending rearwardly thereof and further has front, rear, top and bottom portions. An elongated boom is engaged with the rear portion of the scaffolding and extends forwardly therefrom beyond the scaffolding. The scaffolding further includes a plurality of pulleys connected thereto, disposed adjacent to the boom at different heights respectively, and spaced apart substantially between the top and bottom portions of the scaffolding.

The system further includes a flexible elongated cable supported by the plurality of pulleys and has a first end portion secured to the motor. Another of the plurality of pulleys is secured to the bottom portion of the scaffolding. The cable further has a second end portion including a mechanism such as a hook, for example, for selectively engaging a pallet and causing same to be transported between up and down positions as the motor is operated in a corresponding direction. A support cable having opposed end portions is secured to the plurality of horizontal members and is disposed at a tensed state for assisting to maintain the scaffolding at a secure position.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
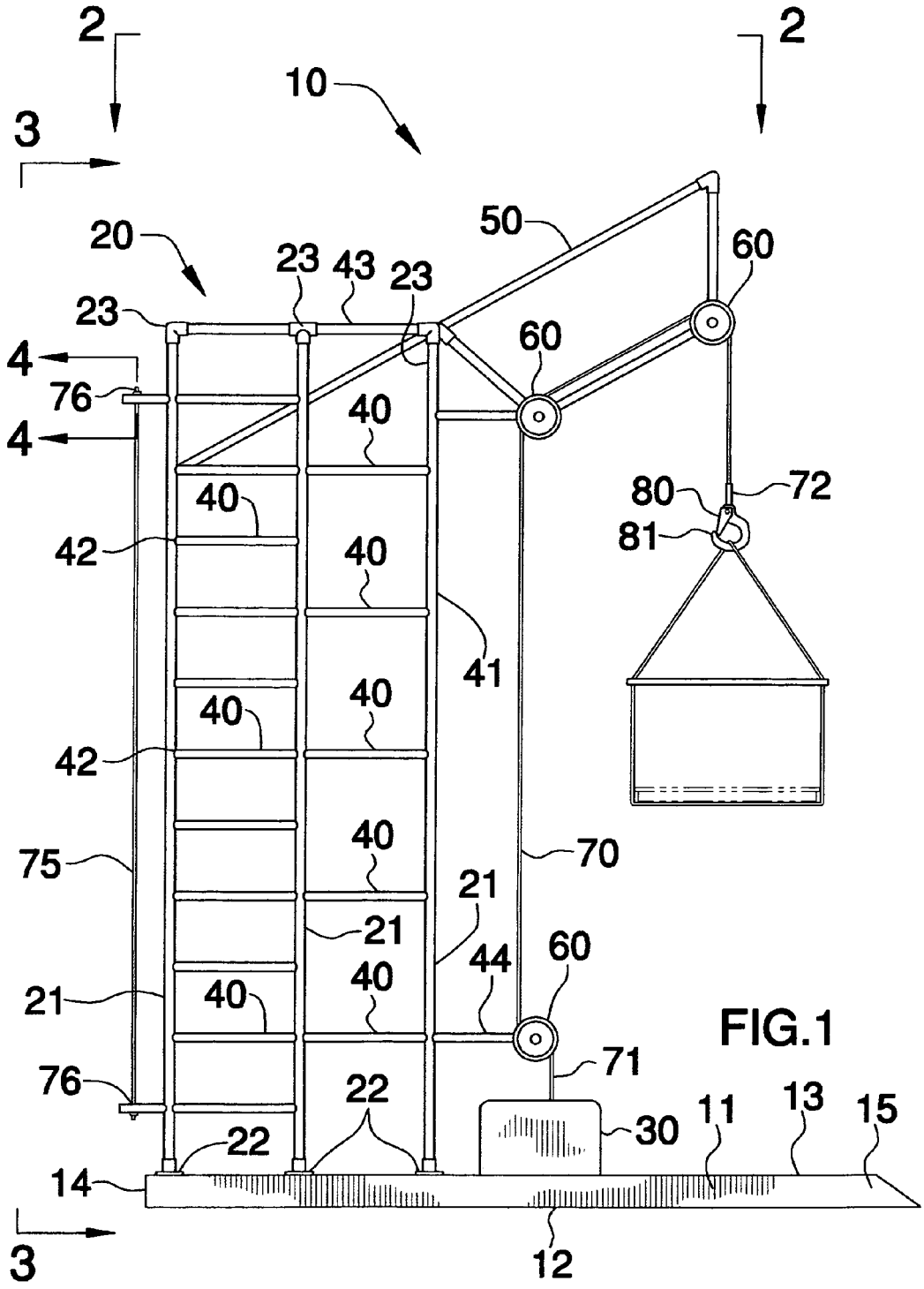
FIG. 1 is a side elevational view showing a scaffolding lift system, in accordance with the present invention.
Figure 2:
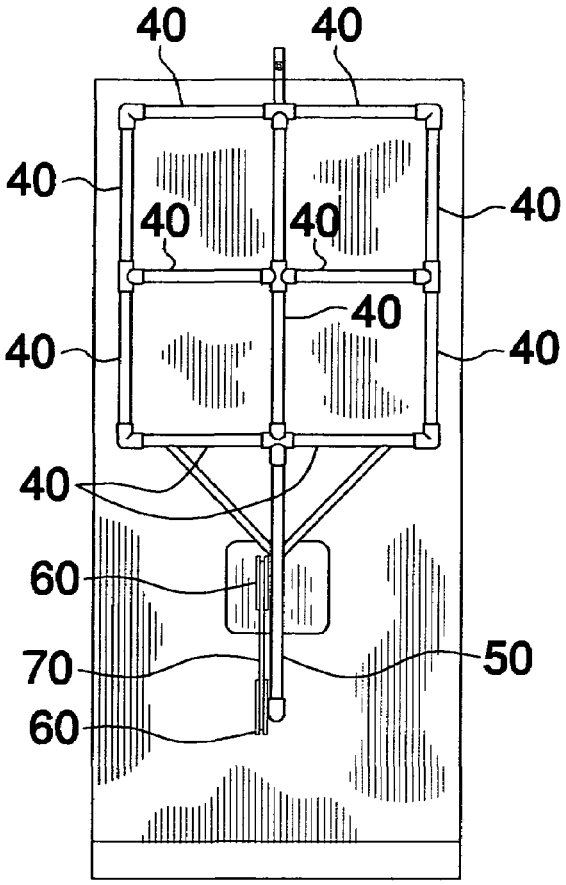
FIG. 2 is a top plan view showing the scaffolding lift system shown in FIG. 1, taken along line 2—2.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

This invention is referred to generally in FIGS. 1–4 by the reference numeral 10 and is intended to provide a scaffolding lift system. It should be understood that the system 10 may be used to lift many different types of objects and should not be limited to only lifting objects up to scaffolds.

Initially referring to FIG. 1, the system 10 includes a base member 11 having substantially planar bottom 12 and top 13 surfaces. The system 10 further includes a scaffolding 20 including a plurality of elongated vertical support members 21 having lower end portions 22 secured to the top surface 13 of the base member 11 and upper end portions 23 extending upwardly therefrom respectively. A power-operated motor 30 is positioned adjacent the scaffolding 20 and on the base member 11. The base member 11 has a rear portion 14 generally aligned with the rear portion 42 of the scaffolding 20 and further has a front portion 15 extending beyond the power-operated motor 30 so that the system 10 can be supported above the base member 11. This provides a solid support for the system 10, thereby stabilizing it and preventing the scaffolding from tipping over when a pallet of heavy building materials is lifted.

Still referring to FIG. 1, the scaffolding 20 further includes a plurality of elongated horizontal support members 40 connected to select ones of the plurality of vertical support members 21 and extend rearwardly thereof and further has front 41, rear 42, top 43 and bottom 44 portions. An elongated boom 50 is engaged with the rear portion 42 of the scaffolding 20 and extends forwardly therefrom beyond the scaffolding 20, as perhaps best shown in FIG. 2. The scaffolding 20 further includes a plurality of pulleys 60 connected thereto, disposed adjacent to the boom 50 at different heights respectively, and spaced apart substantially between the top 43 and bottom 44 portions of the scaffolding 20. Advantageously, the plurality of pulleys 60 enable the system 10 to lift pallets of heavy building materials to an above ground location when operated in concert with the motor 30.

Figure 3:
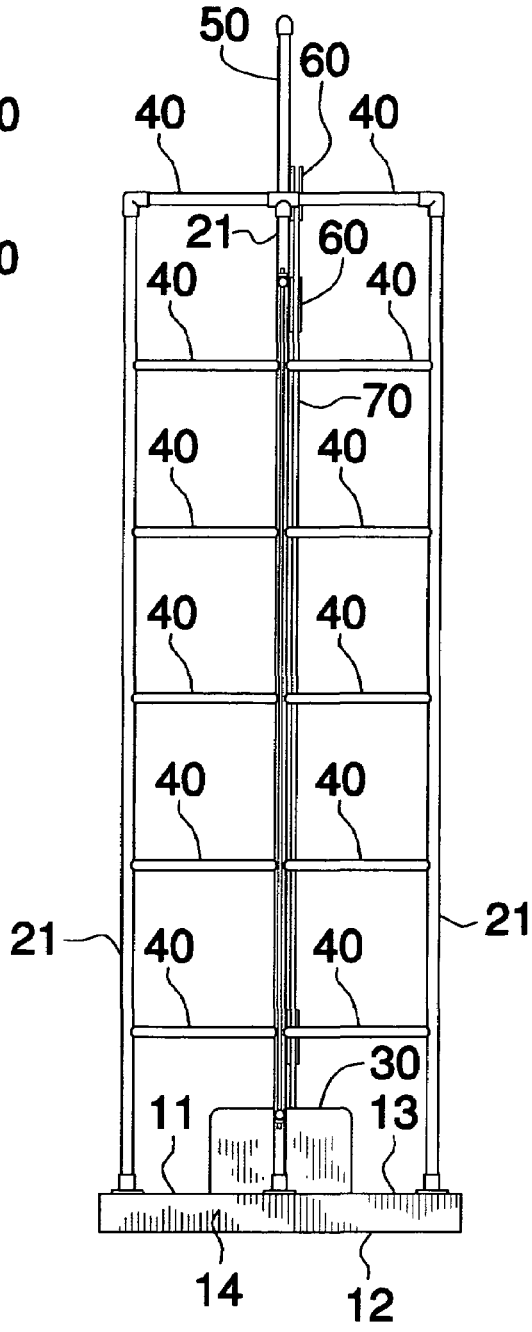
FIG. 3 is a side elevational view showing the scaffolding lift system shown in FIG. 1, taken along line 3—3.
Figure 4:
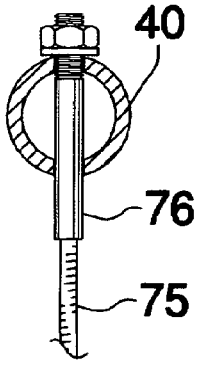
FIG. 4 is an enlarged cross-sectional view showing the support cable secured to the scaffolding taken along line 44.

Now referring to FIGS. 1 and 3, the system 10 further includes a flexible elongated cable 70 supported by the plurality of pulleys 60 and having a first end portion 71 secured to the motor 30. Another of the plurality of pulleys 60 is secured to the bottom portion 44 of the scaffolding 20. The cable 70 further has a second end portion 72 including a mechanism 80 such as a hook 81 for selectively engaging a pallet and causing same to be transported between up and down positions as the motor 30 is operated in a corresponding direction. Of course, other conventional mechanisms may be employed by the present invention to lift the pallet, as well known in the industry. Such mechanisms may include a clasp or pair of claws, for example. A support cable 75 having opposed end portions 76 is secured to the plurality of horizontal members 40 and is disposed at a tensed state for assisting to maintain the scaffolding 20 at a secure position, as perhaps best shown in FIG. 4.

The system 10 enables construction workers to easily lift heavy building materials to a roof or other above ground locations without suffering from back or muscle strains normally associated with carrying heavy materials up a ladder. In addition, the system 10 saves time, money and improves the level of safety at a job site. Its durable, lightweight structure makes disassembling and transporting easy to do.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A scaffolding lift system comprising:

a base member including substantially planar bottom and top surfaces;

a scaffolding including a plurality of elongated vertical support members having lower end portions secured to said top surface of said base member and upper end portions extending upwardly therefrom respectively, said scaffolding further including a plurality of elongated horizontal support members connected to select ones of said plurality of vertical support members and extending rearwardly thereof, said scaffolding further having front, rear, top and bottom portions;

an elongated boom engaged with said rear portion of said scaffolding and extending forwardly therefrom beyond said scaffolding;

a plurality of pulleys being connected to said scaffolding and spaced apart substantially between the top and bottom portions of said scaffolding;

a power-operated motor positioned adjacent said scaffolding and on said base member;

a flexible elongated cable supported by said plurality of pulleys and having a first end portion secured to said motor, said cable further having a second end portion including means for selectively engaging a pallet and causing same to be transported between up and down positions as said motor is operated in a corresponding direction; and a support cable having opposed end portions secured at least two of said plurality of horizontal members and being disposed at a tensed state for assisting to maintain said scaffolding at a secure position.

2. The scaffolding lift system of claim 1, wherein a pair of said plurality of pulleys are disposed adjacent to said boom and are supported thereby.

3. The scaffolding lift system of claim 1, wherein another of said plurality of pulleys is secured to the bottom portion of said scaffolding.

4. The scaffolding lift system of claim 1, wherein said plurality of pulleys are disposed at different heights respectively.

5. The scaffolding lift system of claim 1, wherein said engaging means comprises a hook.

6. The scaffolding lift system of claim 1, wherein said base member has a rear portion generally aligned with said rear portion of said scaffolding and further has a front portion extending beyond said power-operated motor so that said system can be supported above said base.

7. A scaffolding lift system comprising:

a base member including substantially planar bottom and top surfaces;

a scaffolding including a plurality of elongated vertical support members having lower end portions secured to said top surface of said base member and upper end portions extending upwardly therefrom respectively, said scaffolding further including a plurality of elongated horizontal support members connected to select ones of said plurality of vertical support members and extending rearwardly thereof, said scaffolding further having front, rear, top and bottom portions;

an elongated boom engaged with said rear portion of said scaffolding and extending forwardly therefrom beyond said scaffolding;

a plurality of pulleys being connected to said scaffolding and spaced apart substantially between the top and bottom portions of said scaffolding;

a power-operated motor positioned adjacent said scaffolding and on said base member;

a flexible elongated cable supported by said plurality of pulleys and having a first end portion secured to said motor, said cable further having a second end portion including means for selectively engaging a pallet and causing same to be transported between up and down positions as said motor is operated in a corresponding direction; and a support cable having opposed end portions secured at least two of said plurality of horizontal members and being disposed at a tensed state for assisting to maintain said scaffolding at a secure position;

said base member having a rear portion generally aligned with said rear portion of said scaffolding and further having a front portion extending beyond said power-operated motor so that said system can be supported above said base.

8. The scaffolding lift system of claim 7, wherein a pair of said plurality of pulleys are disposed adjacent to said boom and are supported thereby.

9. The scaffolding lift system of claim 7, wherein another of said plurality of pulleys is secured to the bottom portion of said scaffolding.

10. The scaffolding lift system of claim 7, wherein said plurality of pulleys are disposed at different heights respectively.

11. The scaffolding lift system of claim 7, wherein said engaging means comprises a hook.

12. A scaffolding lift system comprising:

a base member including substantially planar bottom and top surfaces;

a scaffolding including a plurality of elongated vertical support members having lower end portions secured to said top surface of said base member and upper end portions extending upwardly therefrom respectively, said scaffolding further including a plurality of elongated horizontal support members connected to select ones of said plurality of vertical support members and extending rearwardly thereof, said scaffolding further having front, rear, top and bottom portions;

an elongated boom engaged with said rear portion of said scaffolding and extending forwardly therefrom beyond said scaffolding;

a plurality of pulleys being connected to said scaffolding and spaced apart substantially between the top and bottom portions of said scaffolding, a pair of said plurality of pulleys are disposed adjacent to said boom and are supported thereby;

a power-operated motor positioned adjacent said scaffolding and on said base member;

a flexible elongated cable supported by said plurality of pulleys and having a first end portion secured to said motor, said cable further having a second end portion including means for selectively engaging a pallet and causing same to be transported between up and down positions as said motor is operated in a corresponding direction; and a support cable having opposed end portions secured at least two of said plurality of horizontal members and being disposed at a tensed state for assisting to maintain said scaffolding at a secure position;

said base member having a rear portion generally aligned with said rear portion of said scaffolding and further having a front portion extending beyond said power-operated motor so that said system can be supported above said base.

13. The scaffolding lift system of claim 12, wherein another of said plurality of pulleys is secured to the bottom portion of said scaffolding.

14. The scaffolding lift system of claim 12, wherein said plurality of pulleys are disposed at different heights respectively.

15. The scaffolding lift system of claim 12, wherein said engaging means comprises a hook.

* * * * *